US006464113B1

(12) United States Patent
Vogel

(10) Patent No.: US 6,464,113 B1
(45) Date of Patent: Oct. 15, 2002

(54) CONTAINER WITH A THREADED CAP HAVING A SPRING-LOADED SELF-CLOSING COVER

(75) Inventor: William C. Vogel, Milwaukee, WI (US)

(73) Assignee: Gateway Plastics Incorporated, Mequon, WI (US)

( * ) Notice: Subject to any disclaimer, the term of this patent is extended or adjusted under 35 U.S.C. 154(b) by 0 days.

(21) Appl. No.: 09/728,654

(22) Filed: Dec. 1, 2000

(51) Int. Cl.[7] ..... A47G 19/24
(52) U.S. Cl. ..... 222/480; 222/517; 222/565
(58) Field of Search ..... 222/480, 565, 222/511, 517, 562, 556; 215/200, 232, 316; 220/259, 254, 380

(56) References Cited

U.S. PATENT DOCUMENTS 2,388,738 A * 11/1945 Gudheim ..... 215/232
4,503,991 A * 3/1985 Joyce ..... 220/838
4,693,399 A 9/1987 Hickman et al. ..... 222/480
5,330,082 A 7/1994 Forsyth ..... 222/480
5,971,231 A 10/1999 Samz et al. ..... 222/480
6,250,517 B1 * 6/2001 Samz et al. ..... 222/565

* cited by examiner

*Primary Examiner*—Lesley D. Morris
*Assistant Examiner*—Patrick Buechner
(74) *Attorney, Agent, or Firm*—Nilles & Nilles, S.C.

(57) ABSTRACT

A container with an integrally molded flap for covering an opening has a top that is deflected during cooling to provide a self-closing capability. This capability is provided by causing the top to cool to room temperature when the flaps are closed into a warped shape, either concave or convex in which the hinge formed integral with the flap and the rest of the cover is curved with the flaps closed. This could be done by careful design of the cap such that it warps this way during cooling naturally, or by pressing on the cap during cooling to "set" the cap and hinge in a curved shape. When the flap is opened, the arrangement of the flap and hinge reduce the chance that the flap will return to its as-molded position and jam.

10 Claims, 6 Drawing Sheets

CONTAINER WITH A THREADED CAP HAVING A SPRING-LOADED SELF-CLOSING COVER

FIELD OF THE INVENTION

This invention generally relates to hand-held plastic containers for storing and dispensing particulate matter. More particularly, it relates to such containers with a cover having self-closing, spring-loaded flaps that stay in a substantially closed position even when they are unlatched.

BACKGROUND OF THE INVENTION

Containers for retail products are almost always filled and packaged automatically. The containers are typically routed into narrow channels or troughs that guide the containers down filling, capping, labeling and packaging assembly lines through the factory, In food and medical product manufacturing lines, the containers are most commonly guided by stainless steel rods. Channels made of stainless steel rods can be more easily cleaned using steam and chemical sprays. Regular cleaning after every shift or every day is commonly performed on food and pharmaceutical packaging lines. The rods that form the container-guiding channels are dried easily and do not trap food that can cause bacterial growth.

The channels typically operate using gravity. Occasionally a drive belt supplements these gravity channels while the containers are upright, resting on moving belts, restrained on either side by fences of stainless steel rods that prevent them from falling off the belts. In both arrangements, the containers are rather tightly constrained to prevent the assembly line from jamming. Side rails prevent them from moving side-to-side with significant free play.

One drawback to these processes is their ability to become jammed by containers that catch on the bottom or sidewalls of the channels. For this reason, the containers and tops are designed carefully to eliminate protrusions that might catch on the channels and jam. It only takes a small force, especially in a gravity-fed channel, for containers to stick. One method of reducing the possibility that the flaps will stick during processing is to design them with no protrusions or irregularities and a downward spring effect keeping them close.

U.S. Pat. No. 4,693,399 illustrates a successful cap design that limits jamming: it has a substantially flat top with flaps that do not protrude from the upper surface. The flaps extend to the outer edges of the cap, and together with the sidewalls, define a substantially smooth cylindrical outer surface with a diameter that is substantially the same as the diameter of the body of the container. Yet even this cap is not as good as it can be. The cap of the '399 patent has flexible flaps that are attached to the body of the cap with living hinges formed integrally with the flaps and the body of the cap. As with many integral flap caps, the flaps of the '399 cap are formed by injection molding when they are in a 90° open position. Once the plastic has cooled to the extent it is solid, it then extracted from the mold and the flaps are closed. Since it is formed and cooled in an open position, there is a residual springiness in the hinge when it is closed—a tendency to self-open perhaps 30 or 45 degrees. As a result, if the latch is released during packaging the cap tends to spring open and stay open. Unfortunately, this often causes the container to become jammed in the channels.

One method of reducing this risk is described in U.S. Pat. No. 5,330,082 assigned to Weatherchem Plastics. The cap shown in the '082 patent has a catch that reduces the risk that a flap will open. Instead of having a flange that grips the inside of the covered hole, such as is shown in the '399 patent, the '082 flap wraps around the outside of the hole and pulls inward. As the '082 patent states, this arrangement causes the flap to hold even tighter to the cap as the cap is tightened to the bottle. When the cap is over tightened, the flap is holds ever more tightly to the body of the cap.

While this does reduce the chance that the flap will open and cause the container to be jammed in the assembly line, it suffers from the same drawbacks as the '399 cap: once the flap is opened, it tends to spring to a half-open position. Since both the '399 cap and the '082 cap are integrally formed, they must be made in a flap-open position and later closed. If the flaps pop open for any reasons, they try to return to their as-molded positions. Once the latch or catch releases, they almost immediately spring open. While the '082 patent reduces the possibility that the flaps will spring open, it does not reduce the possibility that flaps sprung open will jam the assembly line.

A person unskilled in the art may well wonder how one could continue a filling and packaging process knowing that a flap of a container was open. Wouldn't the contents of the container spill out when the flap was unlatched, even if it did not open entirely? This may be true of many packaging processes, but not all. Many materials, especially food materials, have an heat induction liner inside the cap that is sealed to the top of the bottle. The cap serves to hold the inner liner in place. In these types of containers, the seal is pushed in using a lining machine. When the flaps open, the seal is still in place and the food material inside cannot escape even though the flap is unlatched. No food can escape or be contaminated merely due to an unlatched flap. As an example, consider the powdered Parmesan and Romano cheese containers for sale in any grocery store. When purchased at the store, all of these containers have an inner liner that must be peeled off in order to gain access to the contents. No food can come out even if the flaps are fully open.

It is the goal of this invention to provide a cap and a process for making that cap that reduce the possibility that its flaps, once unlatched, will spring open toward an as-molded position. It also a goal of this invention to provide a cap with a living hinge that is plastically deformed during cooling to make the flap self-closing. It is also a goal of this invention to provide a filling process for a cap with an internal liner that permits filling and packaging to continue without stopping the assembly line even when the flaps are unlatched.

SUMMARY OF INVENTION

In accordance with a third embodiment of the invention, a container is disclosed that includes a substantially cylindrical receptacle, comprising a circular sidewall, a bottom fixed to and enclosing the lower end of the circular sidewall, and an open upper end, the upper end having a circular opening substantially the same diameter as the outer diameter of the circular sidewall, the upper end having external threads; a circular sealing disc bonded to the top of the receptacle to substantially prevent the entry of water or air into the receptacle; a cap body screwed onto the receptacle and enclosing the circular opening, the cap body further comprising a cylindrical sidewall with internal threads configured to mate with the external threads of the receptacle, and a substantially flat top; a substantially flat flap having a central portion that is depressed with respect to a rim portion of the flap; and a living hinge integrally formed with the flap and the cap body, and hingeably coupling the flap to the cap body to permit the flap to open and close, the hinge having a sufficient displacement in a central portion thereof to retain the flap in a closed position when the flap is not latched in the closed position.

In accordance with a third embodiment of the invention, a container is disclosed that includes a substantially cylindrical receptacle, comprising a circular sidewall, a bottom fixed too and enclosing the lower end of the circular sidewall, and an open upper end, the upper end having a circular opening substantially the same diameter as the outer diameter of the circular sidewall, the upper end having external threads; a circular ceiling disc bonded to the top of the receptacle to substantially prevent the entry of water or air into the receptacle; a cap body screwed onto the receptacle and enclosing the circular opening, the cap body further comprising a cylindrical sidewall with internal threads configured to mate with the external threads of the receptacle, and a substantially flat top; a substantially flat flap having a central portion that is depressed with respect to a rim portion of the flap; and a living hinge intricately formed with the flap and the cap body, and hingeably coupling the flap to the cap body to permit the flap to open and close, the hinge having a sufficient displacement in a central portion thereof to retain the flap in a closed position when the flap is not latched in the closed position.

DETAILED DESCRIPTION OF THE INVENTION

Figure 1:
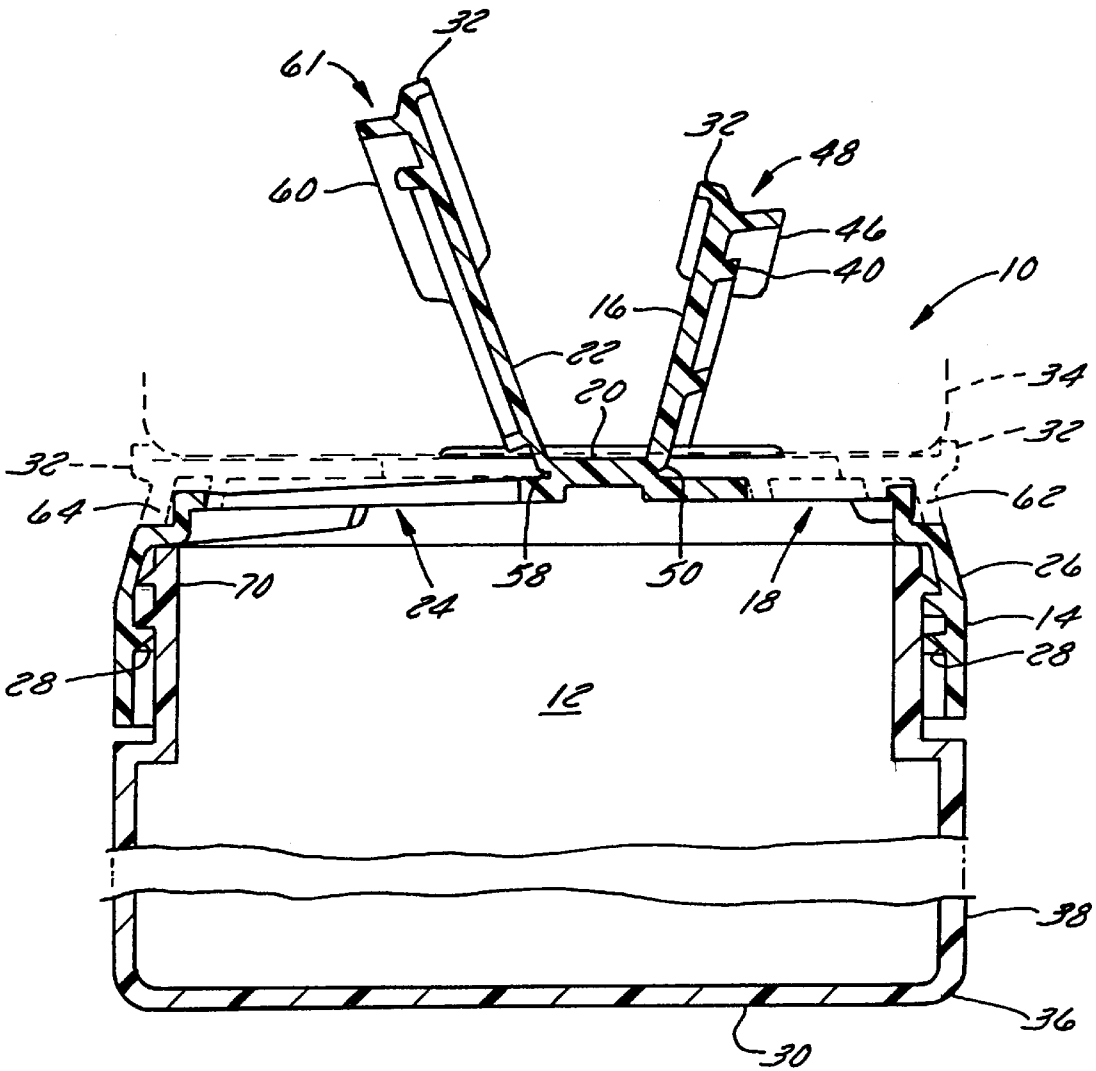
FIG. 1 is a cross-sectional side view of a container including a cover and receptacle in accordance with the current invention showing the flaps in an open position and as dashed lines in a closed position.

Before explaining at least one embodiment of the invention in detail it is to be understood that the invention is not limited in its application to the details of construction in the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

FIG. 1 illustrates a container 10 having a receptacle 12 and a cap or cover 14. Cover 14 includes a shaker flap 16, called a shaker flap because it covers (when closed) shaker openings 18 disposed in planar top portion 20 of the cover. Cover 14 also includes a spooning flap 22 that similarly covers a larger spooning opening 24 also disposed in top portion 20.

Figure 2:
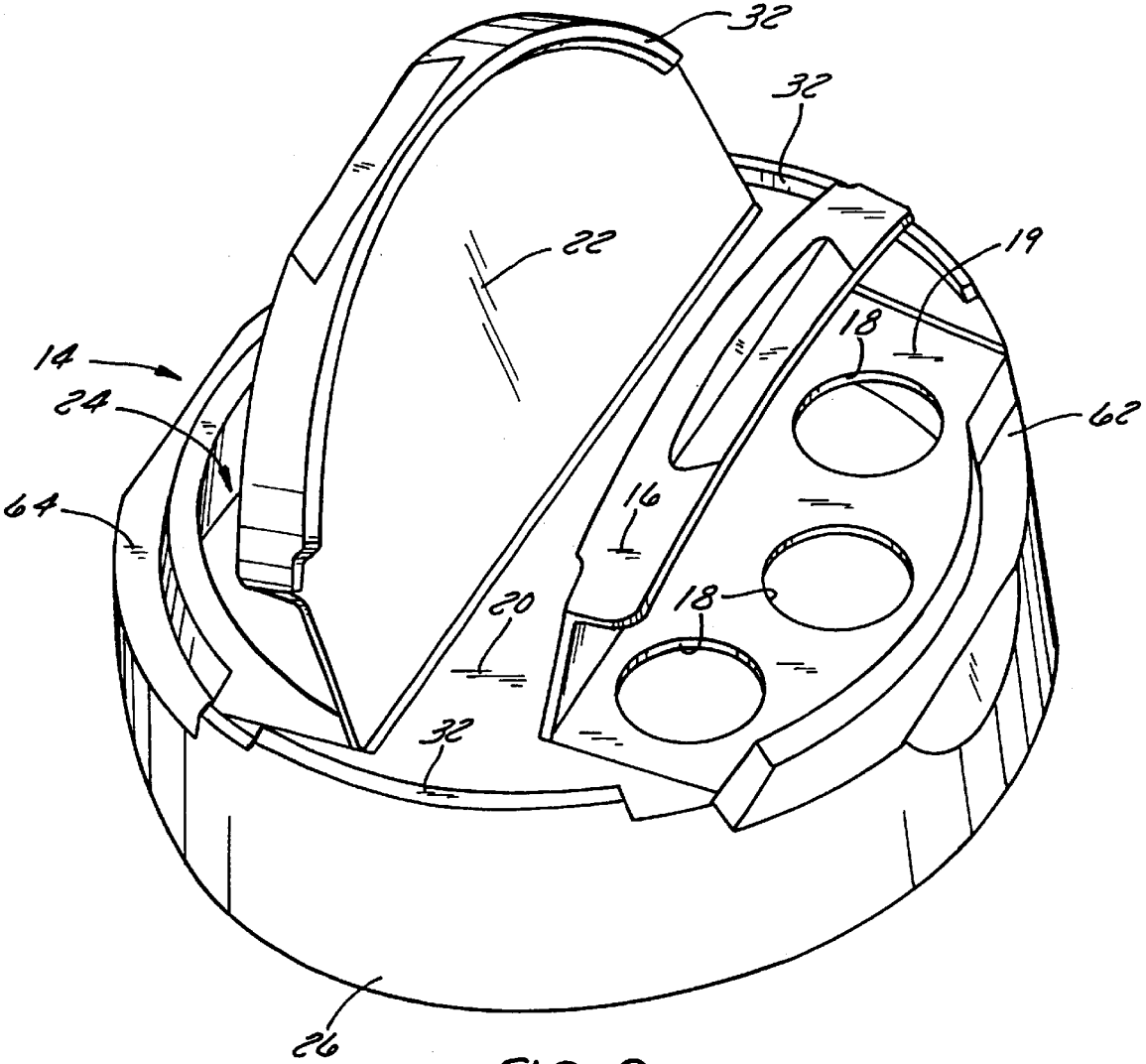
FIG. 2 is an orthogonal view of the cover of FIG. 1, showing the flaps in an open position.

The cover, as best seen in FIG. 2, is in the form of a substantially cylindrical portion 26, and top portion 20 that is coupled to an upper end of cylindrical portion 26 to enclose cylindrical portion 26. Referring to FIG. 1, which shows a portion of the cover in cross-section with the receptacle attached, threads 28 are provided on the inner surface of cylindrical portion 26 for coupling cylindrical portion 26 to the outside of the top of receptacle 12. As seen in FIG. 1, mating threads are disposed on an outer indented top portion of receptacle 12 to engage threads 28. Alternatively, cylindrical portion 26 may be equipped with an inner detent or a raised ring to allow it to be snap connected to the top portion of receptacle 12. Referring to FIG. 2, an elongate recess 19 is provided in which shaker flap 16 will fit when flap 16 is in a closed position, to provide a substantially flat upper surface of top portion 20 on which a similar container can be stacked.

Referring back to FIG. 1, receptacle 12 includes a substantially planar bottom portion 30 that is adapted to engage a lip 32 of cover 14. There is a significant advantage to this feature: since the bottom portion 30 is adapted to engage lip 32, then a plurality of containers identical to the one pictured in FIGS. 1 and 2 can be stacked one atop the other, lip 32 serving to orient the bottom of the next higher container and so keep the containers in proper alignment when stacked. In FIG. 1, two identical containers are shown in this stacked arrangement, the bottom of the upper container being shown as dashed line 34 engaging rim 32 when the flaps of the lower container are in a closed position (shown in FIG. 1 as dashed lines when in their closed positions). It can be seen that bottom portion 30 (and hence identical bottom portion 34) and top portion 20 with lip 32 are adapted to engage one another. Lip 32 is disposed at an outer edge of cover 14 to engage a recess 36 at the junction of bottom 30 and wall 38 of receptacle 12. By disposing both lip 32 and recess 36 to engage each other near the outer periphery of the container, study has shown that the containers are more easily stacked, and when stacked tend to self-center. A portion of lip 32 is preferably disposed on shaker flap 16, spooning flap 22 as well as on the non-hinged sides of top portion 20 as can be best seen in FIG. 4. Each of these portions is preferably disposed at an outer edge of cover 14 and have substantially the same diameter. Other designs, provide orienting means disposed more closely to the center of the container, such as by providing an indentation at or near the center of the receptacle bottom that engages with an upwardly extending protrusion located near the center of the cover on which it is stacked, are more difficult to stack accurately and also tend to tip more easily. In addition, it is harder to hold tolerances on an inner indentation than an outer indentation as shown in FIG. 1. These designs have the added disadvantage of requiring an internal recess to be formed in the center of the receptacle bottom, requiring additional machining to manufacture.

Referring to FIGS. 1 and 2, a plurality of oval shaker openings 18, preferably substantially circular as shown here, are provided to allow foodstuffs within the container to be shaken out when shaker flap 16 is opened. These openings are preferably arranged not along a straight line, but along an arc. On the underside of shaker flap 16 is an arcuate flange 40 adapted to engage and seal central shaker opening 18. This flange extends for about 30 degrees around the periphery of its mating opening 18 when in a closed position. Flange 40 engages the inner surface of opening 18 and holds the shaker flap closed.

Figure 3:
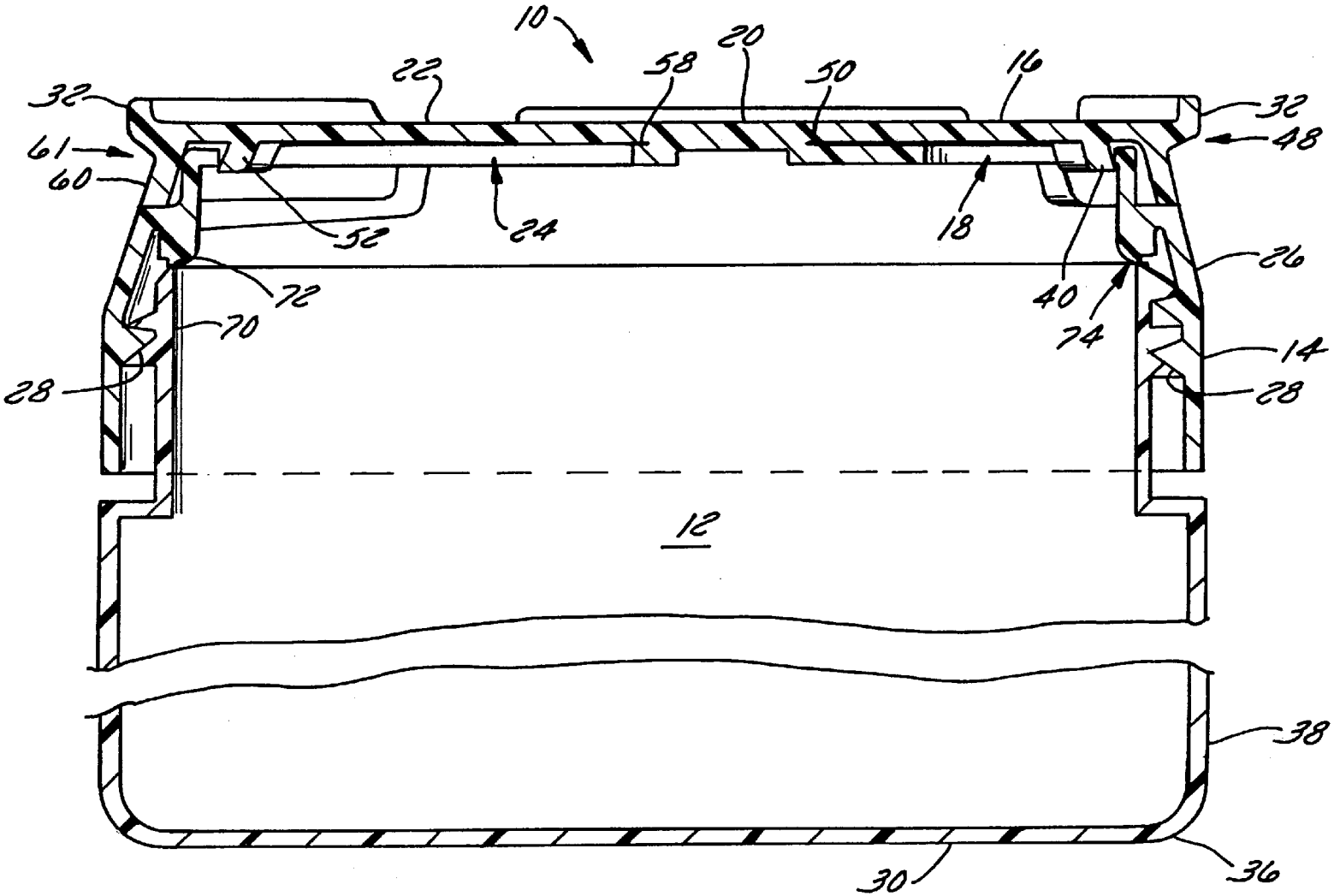
FIG. 3 is a cross-sectional view of the container of FIG. 1 showing the orientation of the flap skirts.

FIG. 3 shows cover 14 in cross-section along a diametral line of the cover. The cross section is perpendicular to both the shaker flap hinge 50 and the spooning flap hinge 58. Flange 40 does not extend perpendicularly from the underside of shaker flap 16, but downward and outward at an angle of between 9 and 25 degrees, and more preferably of between 5 and 20 degrees with respect to the longitudinal axis of container 10. This angular relationship is particularly beneficial in that it allows the cover, including the flaps, to be readily and integrally molded as a single monolithic piece. In addition, this angle allows flange 40 to releasably lock into central opening 18 when shaker flap 16 is closed.

Shaker flap 16 also includes a skirt 46 that extends downwardly from shaker flap 16. Skirt 46 is disposed an outer edge of shaker flap 16. Skirt 46 is indented into the cap to provide, together with the outer surface of cylindrical portion 26 a substantially right circular cylindrical wall.

Skirt 46 has an indentation 48 disposed at a central outer portion of skirt 46 and is configured to receive a finger or fingernail of the user. This allows the user to grasp shaker flap 16 and readily open container 10 by lifting upward on the indentation.

Figure 4:
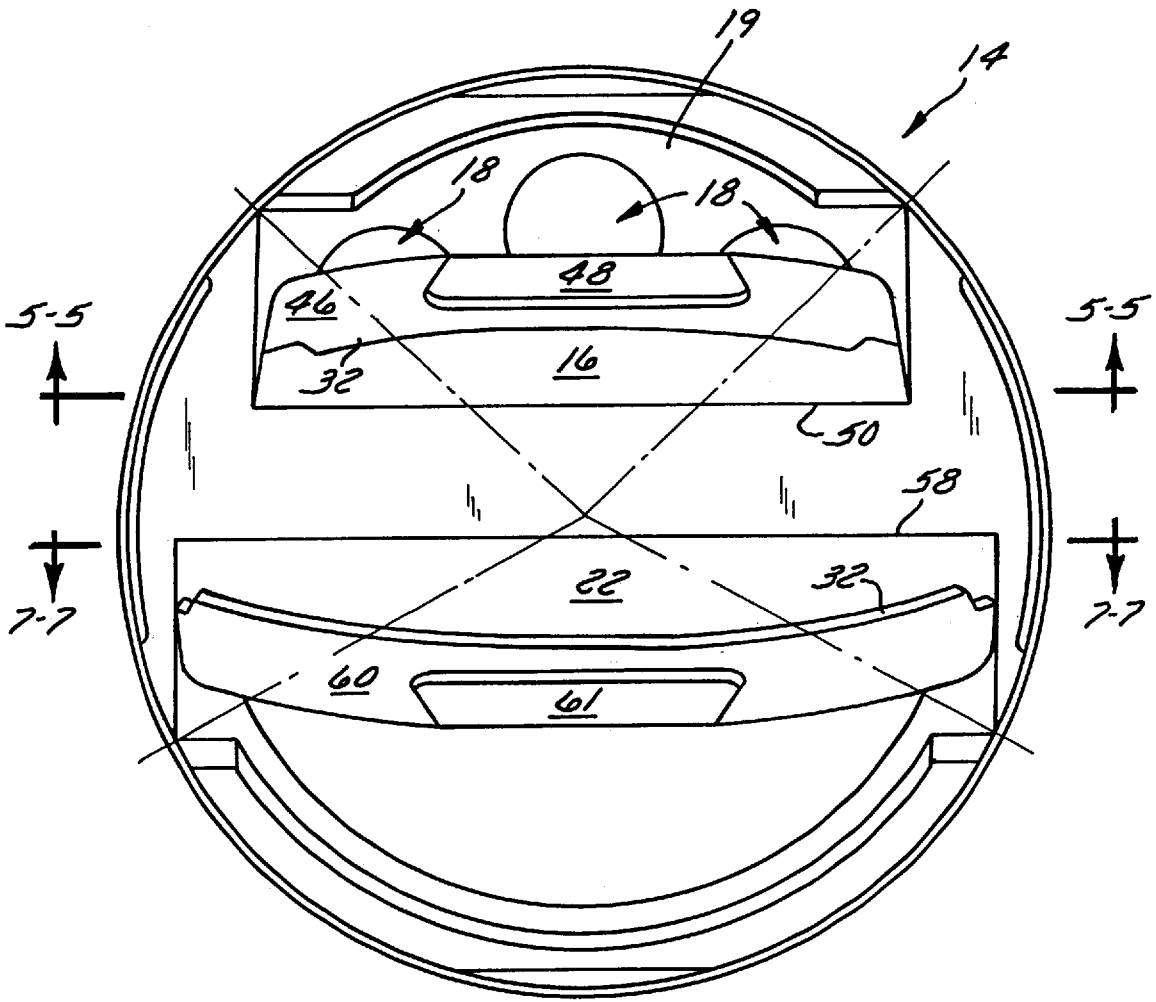
FIG. 4 is a top view of the cover of FIG. 1 with the flaps in an open position.

Skirt 46 preferably extends around cover 14 for an arcuate length of between 60 and 120 degrees (see FIG. 4). From an outward appearance, therefore, skirt 46 would appear to form between 60 and 120 degrees of the circumference of the upper part of cover 14. This provides a significant advantage in the design of cover 14.

Since skirt 46 is arcuate, rather than straight, it is less likely to be bent over when the cover is grasped and opened, and further distributes the grasping load more evenly around the outer edge of shaker flap 16. This allows shaker flap 16 to be made thinner and therefore to require less plastic when manufactured.

Referring to FIG. 3, when the shaker flap 16 is closed, flange 40 engages an outer portion of shaker opening 18 to thereby releasably lock shaker flap 16 to top portion 20 in a closed position. While only a single flange 40 is shown in cross section in FIG. 4, each of the other openings 18 may also have a flange (not shown) to provide additional engagement surfaces and thereby hold the shaker flap closed even better.

Shaker flap 16 is coupled to top portion 20 by a flexible and integrally formed hinge 50 preferably extending the entire length of shaker flap 16.

Spooning flap 22 is coupled to top portion 20 by a flexible and integrally formed hinge 58 preferably extending the entire length of spooning flap 22. Note that, unlike certain prior art covers with hingeable flaps, hinges 50 and 58 are disposed adjacent to a diametral line of cover 14 to allow the flaps to hinge upward and toward the middle of cover 14. In prior art covers, the hinges were formed along an outer edge of the cover, which allowed the flaps to be opened upward and outward. This caused the flap to dangle in its open position. As a result, the flap was often in the way of the material being shaken out of the container, causing the flap to be covered with the foodstuffs or other materials inside.

Spooning flap 22 covers spooning opening 24. Spooning flap 22 has a flange 52 depending from a lower surface of spooning flap 22 that engages and locks against the inside of opening 24. As with flange 40 on the shaker flap, Flange 52 does not extend perpendicularly from the underside of spooning flap 22, but extends at an angle, preferably between 9 and 25 degrees outward and downward away from the underside of the spooning flap.

As with flange 40 of the shaker flap, by disposing flange 52 at this angle, cover 14 can be manufactured in a single piece with spooning flap 22 formed integrally with cover 14. Flange 52 preferably has an arcuate length of between 20 and 180 degrees (shown as 20 degrees here). Over this length, flange 52 engages the inside edge of spooning opening 24 to releasably lock spooning flap 22 to top portion 20 when spooning flap 22 is in a closed position.

Spooning flap 22 also includes a skirt 60 like skirt 46 of the shaker flap. Like skirt 46, skirt 60 extends downwardly from spooning flap 22 near an outer edge of spooning flap 22 and has an arcuate shape to define an outer substantially vertical surface of cover 14 when spooning flap 22 is in a closed position. Skirt 60 has an indentation 61 disposed at a central outer portion of skirt 60 and is configured to receive a finger or fingernail of the user. This allows the user to grasp spooning flap 22 and readily open container 10. Skirt 60 preferably extends around the circumference of cover 14 when in the closed position for an angle pi of between 100 and 150 degrees (see FIG. 4). From an outward appearance, therefore, skirt 60 would appear to form between 100 and 150 degrees of the circumference of the upper part of cover 14. As with skirt 46 of shaker flap 16, since skirt 60 is arcuate, rather than straight, it has greater structural strength and it is less likely to be bent over when its flap is grasped and opened, and further distributes the grasping load more evenly around the outer edge of spooning flap 22. This allows spooning flap 22 to be made thinner and therefore to require less plastic when manufactured. Note that the arcuate length of skirt 60 is preferably greater than the arcuate length of skirt 46. This additional arcuate length of skirt 60 therefore provides additional strength to spooning flap 22 when the user attempts to open spooning flap 22.

A recess 62 is provided in the cylindrical portion of cover 14 to receive skirt 46 of shaker flap 16. By providing recess 62, skirt 46 can be set into an outer surface of cover 14 when shaker flap is closed, thereby reducing the risk that skirt 46 will be accidentally jostled and caught, shaker flap 16 opened and the contents of container 10 spilled. Similarly, a recess 64 is provided in cover 14 on the opposite side of cover 14 from recess 62 to similarly receive skirt 60 of spooning flap 22 for the same reason. The effect of skirts 46 and 60 being recessed is that the skirts form a smooth and contiguous part of the outer surface of the cylindrical portion of cover 14.

The cover has additional features that cannot be seen easily in the foregoing figures. For that reason, FIGS. 6–9 show these features in more detail, enlarged and somewhat exaggerated, in the case of FIGS. 7 and 9.

The flaps on the cover are integrally formed with the rest of the cover, as are the two living hinges 58, 50 that join the flaps to the rest of the cover. In order to form the facing surfaces of the flap and cover—the surfaces that face each other when the flaps are closed—it is necessary to mold the cover with the flaps open. When closed, the mating and facing surfaces of the flaps and the remainder of the cover cannot be accessed.

The cover is molded with the flaps in a substantially open position shown in FIGS. 1, 2, and 4. As a result, the cover is initially cooled and solidified in the mold cavity with the flaps in an upright position. Once the cover has cooled enough to substantially retain its shape, the mold is parted and the cover ejected from the mold cavity. At this point the cover is still quite plastic. If it is permitted to cool in this flap-open position, it will substantially retain the shape it had immediately after being taken out of the mold. The living hinges will cool and "set" in the half-open position shown in FIGS. 1, 2, and 4.

When the hinges have set in this position, the flaps can be closed and latched, but, when unlatched for any reason, will tend to flip open to the half-opened position shown in FIGS. 1, 2 and 4. If the flaps open accidentally when the containers are being filled and transported down the assembly line, the flaps in this half-opened position will cause the containers to jam.

To reduce the tendency to open, the flaps can be immediately closed and latched while they are still hot from their initial molding. The cover is still substantially plastic while in this hot post-ejection state. If the cover is deformed at this temperature, the plastic will take the form of the deformation once it has cooled. For this reason, the flaps are closed immediately after cooling, and therefore some of their tendency to spring open when unlatched is reduced: if they are unlatched, they may open up somewhat, but not as wide as their as-molded positions. Even so, the flaps will open enough to jam some filling and capping assembly lines.

Figure 6:
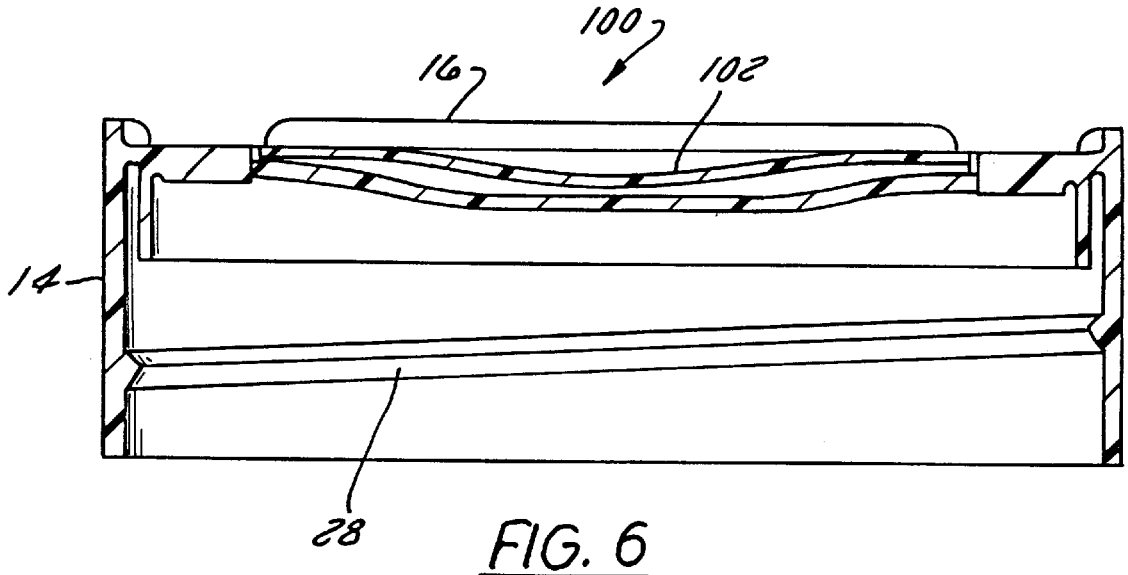
FIG. 6 is a cross-sectional view of the cover of FIG. 5 with the central top portion of the cover in a depressed position as it forms during the initial cooling phase.
Figure 8:
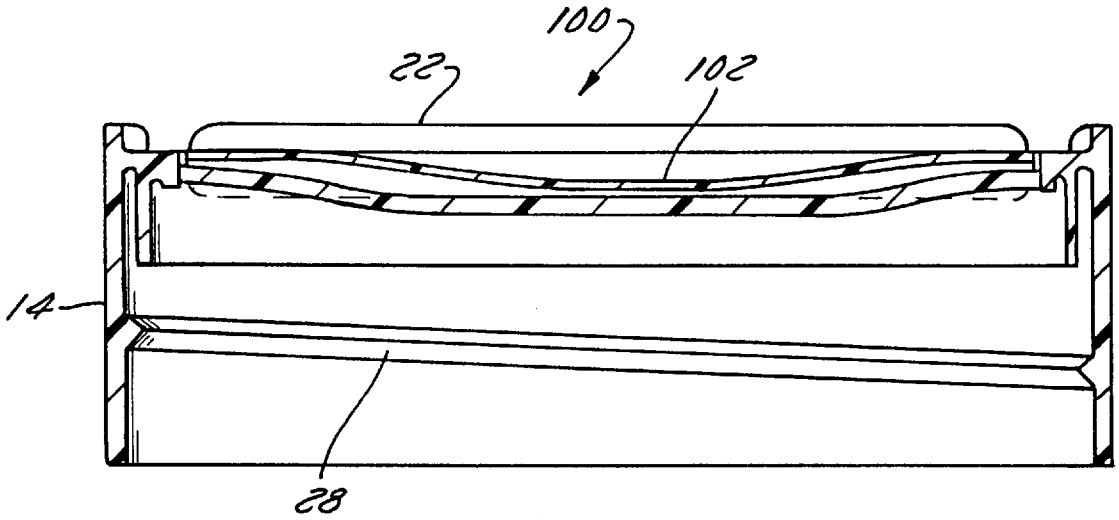
FIG. 8 is a cross-sectional view of the cover of FIG. 7 with the central top portion of the cover in a depressed position as it forms during the initial cooling phase after molding.

For this reason, the central portion 100 of the cap is depressed roughly in the center of the cap, the deepest point being near the longitudinal center point of the two hinges. It has the rough shape of a crater or a very shallow satellite TV antenna. For a cap that is approximately two-and-a-half inches across, the cap is dented in the middle only between about 0.05 inches to 0.1 inches. FIGS. 6 and 8 show an exaggerated indentation 102 to make the crater or dish shape more clearly visible.

This crater or dish shaped indentation provides the spring-closing (and holding closed) capability of the cap discussed below.

Figure 5:
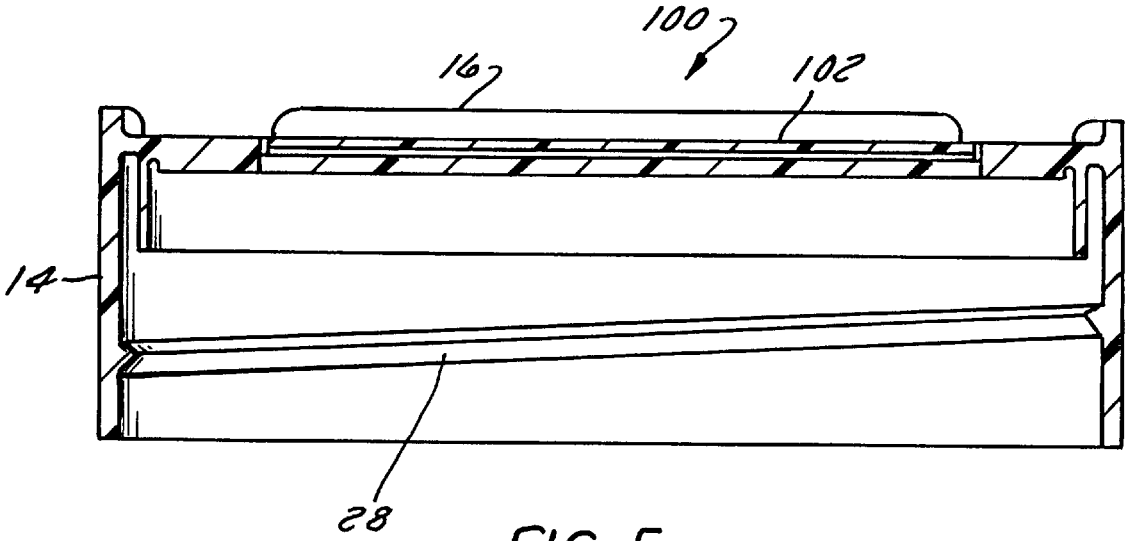
FIG. 5 is a cross-sectional view of the cover immediately after it has been molded, as it would appear at Section 5—5 in FIG. 4 with the flap in a closed position showing hinge 50 extending in a substantially straight line.
Figure 7:
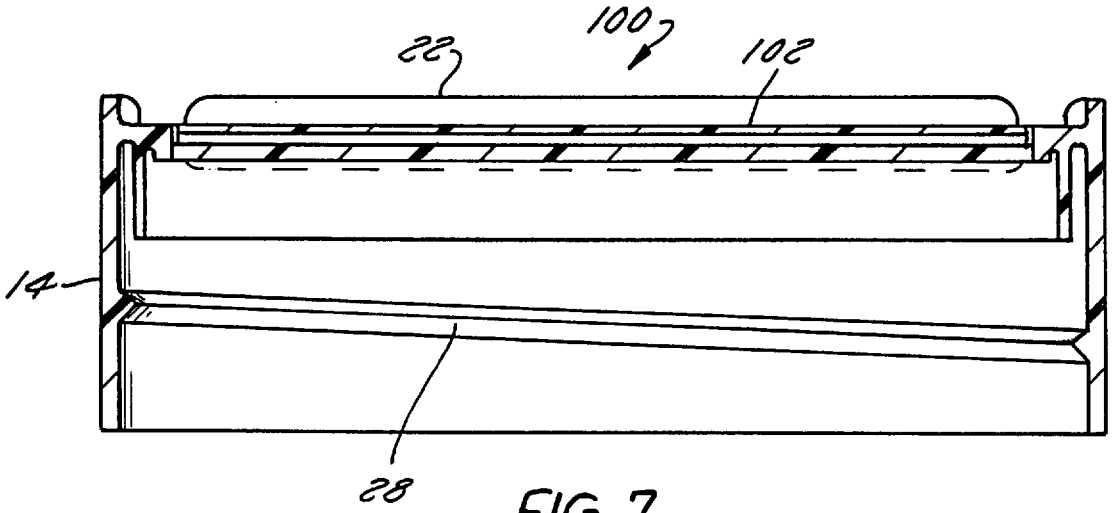
FIG. 7 is a cross-sectional view of the cover immediately after it has been molded as it would appear at Section 7—7 in FIG. 4 with the flap in a closed position showing hinge 58 extending in a substantially straight line.

FIGS. 5 and 7 show the cap in cross-section in its as-molded shape, right after extraction from the mold cavity, and after the spooning flap (FIG. 7) and the shaker flap (FIG. 5) have been closed and latched. In FIGS. 5 and 7, the cap is shown in cross section, the sections taken at section line 5—5 (FIG. 5) and at section line 7—7 (FIG. 7) in FIG. 4. In FIGS. 5–8, unlike FIG. 4, the flaps are lowered and snapped shut.

Note that the top surface of the cap defined by the spooning and shaker flaps is substantially flat. This is the preferred shape of the cap as-molded, and as it would appear when the flaps of the cap are latched closed initially.

Once molded, the flaps are closed or substantially closed, such that the top of the cap and the top of the flap to which it is connected (via the integral hinge) both lie in the same plane. In other words, they are preferably flat. The flaps are preferably latched closed as well.

The top of the cap is deflected downward, preferably while it is still cooling and is somewhat plastic, although still solid. This deflected position is shown in FIGS. 6 and 8, which are taken at the same section lines as FIGS. 5 and 7, respectively. The cap is so deflected either mechanically or by the careful design of the flap and cap such that the post-molding cooling and contracting process causes the center of the cap to deflect downward without mechanical assistance.

Normally, such downward deflection is scrupulously avoided. For most cap designs, the final shape of a cap is the shape it is molded in. To purposefully mold a cap in a flat condition, then have it warp during cooling by the 0.05 or 0.10 inches described in this application is considered a mistake. Yet it is precisely this post-molded warping (either mechanically induced or natural) that provides the self-closing features of the cap.

Note that the recessed central portion of the cap is substantially conical. For example, the preferred recess for a 0.050-inch thick top and 0.050 thick flap with a diameter of about 2 inches is on the order of about 0.08 to 0.11 inches from the as-molded height of the central portion. Compare FIG. 5 to FIG. 6 and FIG. 7 to FIG. 8.

The integrally formed hinges are also recessed. Section lines 5—5 and 7—7 in FIG. 4 are both immediately adjacent to the spooning flap and the shaker flap hinges, respectively. These hinges have substantially the same degree of deflection as the flaps to which they are coupled.

If the caps are deflected mechanically, the deflecting force is applied until the caps have cooled and solidified in the deflected position. Some rebound, however, should be expected. At this point the mechanical means can be removed and the caps will stay in the deflected position. In cases where the deflection is caused by careful design of the cap and subsequent warping during cooling, the cap need have no mechanical force applied. The cap will shrink during cooling and will automatically assume the proper indented shape.

I would like to explain, using the drawings of FIGS. 5–8 just how the indentation and the resulting curvature of the top portion of the cap and the flaps attached thereto work to spring load the flaps and keep them closed.

In the closed, cooled and indented shape, as shown in FIGS. 6 and 8, the spooning and shaker flaps and the top itself are deformed downward and the top portion of the cap has a recess. This downward deformation of both the upper portion of the top and the flaps that are coupled to it are due to the plastic deformation of the cap and flap during cooling. Even if there is no external force applied to the flap and cap, they will remain in these depressed or indented positions. To move them back to a flat position as they were formed in the mold cavity some external force must be applied.

A person opening the flaps applies this force, and it is the release of this elastic tension that causes the flaps to close automatically. When the flaps are lifted by the customer's finger, they first unsnap. As the customer opens them further, the hinges will automatically flatten out and extend substantially straight. Since the hinge in the preferred embodiment is relatively narrow, it will also flatten out both the top of the cap and the flap to which it is connected. The more the user lifts the flap, the flatter and flatter the hinge and top become. By the time the user has lifted the flap to a straight up position, (90 degrees open), the hinge is substantially straight, and as a result, the indentation in the top and the opened flap are reduced. In order to straighten out either hinge, whether the flap is closed or open, requires force to be applied to the cap and flap, a force that is sufficient to make both the top of the cap and the flap flatter. The work required to flatten out the hinge and hence the work required to open the flap 90 degrees is roughly the same amount of work necessary (when the flap is closed) to flatten out the hinge. One can flatten out the hinge once it is indented and set by pressing upward on the bottom of the cap to remove the indentation and make the hinge straight.

When polymeric cap materials are used, this deflection of the top and flap are not plastic, but elastic. The work done on the flap to open it is stored in the planar top and in the flap as potential energy. The flap and the top are, in effect, springs, and the flap is therefore spring-loaded when it is opened.

Both the flap and the top are under tension when either flap is opened. As with any other spring, when the flap is released, the flap snaps back to its relaxed position: a closed or substantially closed position. As it snaps back, the top and the flap again assume their depressed or indented shape.

A significant amount of force is required to open the flap even if it is already unsnapped as compared to the force necessary to flex the hinge alone. The additional amount of force beyond that required to flex the hinge is the force required to bend the top of the cap and the flap into a flatter shape as compared to their indented shape.

As the flap is first opened, the force required to open the flap or to hold the flap in an open position is significant. As one opens the flap farther and farther, the force required to open the flap, or to hold the flap in its current position starts to drop. Finally, as the flap approaches a 90 degree open position, the force required to open the flap or hold the flap open drops even lower. This dropping amount of force means that the flap is held closed quite firmly when the flap has just become unlatched. It takes the greatest amount of force to actually open the flap at that point.

The force-to-opening relationship is particularly beneficial to prevent the flap from flopping open if it becomes unlatched during the bottle filling and capping process. Since the flaps are initially closed during capping, and since the capping process causes the flaps merely to pop unlatched, they are typically in a just-unlatched-but-almost-completely closed position. In typical integrally molded caps with living hinges, once the flap is unlatched, it tends to assume its as-molded shape: half-open. By providing the spring action of the flap and of the top of the cap, the spring force is sufficient to keep the flap from further opening up once it is unlatched. The force required to open the flap is greater than the force applied by the hinge "relaxing" to its as-molded position. As a result, even when the flap is unlatched, it stays closed.

At the same time, however, the flap is not too difficult to open, since the force required to open the flap drops off as the flap goes from a high force at about 5–15 degrees to a small opening force at 90 degrees. Unlike other spring loaded covers, the opening force does not keep increasing as the flap is opened further, but drops over a significant portion of the flap's range between 5 degrees and 90 degrees, to the point that the flap will not close when released at a points between 80 and 120 degrees. This point of automatically staying open can be varied by changing the thickness of the flap, the thickness of the top of the cap, and the length and thickness of the hinge.

ALTERNATIVE STRUCTURES

It is the cap and flap that cause the hinge to curve when it is in a closed position and cause the cap to stay closed even if the catch or latch is released. When no external force is applied to the flap, it seeks to return to a shape in which the hinge, the flap and the top are curved.

When no external force is applied to the cap, it also seeks to return to a shape in which the hinge, the flap and the top are curved. In the figures herein, this relaxed and curved shape is produced by depressing the central portion of the cap while the flaps are closed during initial cooling and cap solidification.

Alternatively, the same curved shape can be provided by pressing upwards on the bottom side of the cap when the flaps are closed and the cap is cooling after injection molding in order to make a convex top. Rather than providing the flaps, hinges, and top of the cover with a crater-like dented in portion, they can be dented outward, so that the flap, the top of the cover and the hinges are bent upwards. Rather than a crater-shaped cap top, there will be a dome-shaped cap top.

Whether the cap is concave (crater-shaped) or convex (dome-shaped), the effect is the same: in order to open the flap, the hinge must be straightened out, and this requires an applied force that not only straightens the hinge, but straightens the concave or convex portions of the cap, the flaps and the hinges.

Hence, whether the hinge is curved upward or downward on the ends, or whether the flap and cap are curved upward, downward, makes little difference.

A second point is that the hinges need not be continuous across the width of the flap to provide this spring-closing feature. The continuous hinge could be replaced with several hinge sections that are similarly pulled into line with each other when the flap is opened.

Thus, it should be apparent that there has been provided in accordance with the present invention an improved container that fully satisfies the objectives and advantages set forth above. Although the invention has been described in conjunction with specific embodiments thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. A molded plastic cap, comprising:

a cap body having a first hole and a second hole through which material is shaken or poured and a first latching surface and a third latching surface;

a first flap integrally formed with the cap body and having a second latching surface disposed to engage the first latching surface to hold the first flap in a latched position sealing the first hole;

a first living hinge joining the cap body to the first flap, wherein the first living hinge is disposed to hold the first flap closed even when the first flap is not in the latched position;

a second flap integrally formed with the cap body and having a fourth latching surface disposed to engage the third latching surface to hold the second flap in a latched position sealing the second hole;

a second living hinge joining the cap body to the second flap, wherein the second living hinge is disposed to hold the second flap closed even when the second flap is not in the latched position;

wherein the first hinge is disposed along a substantially straight line, having a central portion located around the middle of the first flap and two end portions, each such end portion disposed at each end of the first hinge;

wherein the central portion of the first hinge is disposed below the end portions of the first hinge far enough to provide a closing moment to the first flap sufficient to hold the first flap in a closed position when the first flap is not in a latched position; and wherein the central portion of the first hinge is disposed with respect to the end portions of the first hinge such that it moves from a position below the end portions to a position coaxial with the end portions when the first flap is rotated to a 90-degree open position.

2. A molded plastic cap, comprising:

a cap body having a first hole and a second hole through which material is shaken or poured and a first latching surface and a third latching surface;

a first flap integrally formed with the cap body and having a second latching surface disposed to engage the first latching surface to hold the first flap in a latched position sealing the first hole;

a first living hinge joining the cap body to the first flap, wherein the first living hinge is disposed to hold the first flap closed even when the first flap is not in the latched position;

a second flap integrally formed with the cap body and having a fourth latching surface disposed to engage the third latching surface to hold the second flap in a latched position sealing the second hole;

a second living hinge joining the cap body to the second flap, wherein the second living hinge is disposed to hold the second flap closed even when the second flap is not in the latched position;

wherein the first hinge is disposed along a substantially straight line, having a central portion located around the middle of the first flap and two end portions, each such end portion disposed at each end of the first hinge;

wherein the central portion of the first hinge is disposed below the end portions of the first hinge far enough to provide a closing moment to the first flap sufficient to hold the first flap in a closed position when the first flap is not in a latched position; and wherein the central portion of the first hinge is in tension and the end portions of the first hinge are in compression when an opening force is applied to the first flap and the first flap is in a substantially closed position, and further wherein the tensile force and the compressive forces apply a closing moment on the first flap that tends to close the first flap when the first flap is released.

3. A molded plastic cap, comprising:

a cap body having a first hole and a second hole through which material is shaken or poured and a first latching surface and a third latching surface;

a first flap integrally formed with the cap body and having a second latching surface disposed to engage the first latching surface to hold the first flap in a latched position sealing the first hole;

a first living hinge joining the cap body to the first flap, wherein the first living hinge is disposed to hold the first flap closed even when the first flap is not in the latched position;

a second flap integrally formed with the cap body and having a fourth latching surface disposed to engage the third latching surface to hold the second flap in a latched position sealing the second hole;

a second living hinge joining the cap body to the second flap, wherein the second living hinge is disposed to hold the second flap closed even when the second flap is not in the latched position;

wherein the first hinge is disposed along a substantially straight line, having a central portion located around the middle of the first flap and two end portions, each such end portion disposed at each end of the first hinge; and wherein the central portion of the first hinge is in compression and the end portions of the first hinge are in tension when an opening force is applied to the first flap and the first flap is in a substantially closed position, and further wherein the compressive forces and the tensile forces apply a closing moment on the first flap that tends to close the first flap when the first flap is released.

4. A container comprising:

a cylindrical receptacle, comprising a circular sidewall, a bottom fixed to and enclosing the lower end of the circular sidewall, and an open upper end, the upper end having a circular opening the same diameter as the outer diameter of the circular sidewall, the upper end having external threads;

a circular sealing disk bonded to the top of the receptacle to substantially prevent the entry of water or air into the receptacle;

a cap body screwed onto the receptacle and enclosing the circular opening, the cap further comprises a cylindrical sidewall with internal threads configured to mate with the external threads of the receptacle, and a flat top;

a flat first flap having a central portion that is depressed with respect to a rim portion of the first flap;

a first living hinge integrally formed with the first flap and the cap body, and hingeably coupling the first flap to the cap body to permit the first flap to open and close, the first hinge having a displacement in a central portion thereof sufficient to retain the first flap in a closed position when the first flap is not latched in the closed position;

a flat second flap having a central portion that is depressed with respect to a rim portion of the second flap;

a second living hinge adjacent to the first living hinge that is integrally formed with the second flap and the cap body, and hingeably coupling the second flap to the cap body to permit the second flap to open and close, the second hinge having displacement in a central portion thereof sufficient to retain the second flap in a closed position when the second flap is not latched in the closed position; and wherein the first flap and the first hinge are configured to be flattened when the first flap is opened.

5. The container of claim 4, wherein the first flap, when released, snaps to a closed position.

6. The container of claim 5, wherein the closed position is not a closed and latched position.

7. The container of claim 6, wherein the first flap and the first hinge are configured such that the first flap does not snap closed when the first flap is released from a 90 degree open position.

8. A molded plastic cap, comprising:

a cap body comprising an internally threaded cylindrical skirt and a planar and circular top coupled to the skirt to define an open-ended cylinder, the circular top defining an elongate diametral web portion and the planar top having first and second holes through which material is shaken or poured and first and second latching surfaces;

a first flap integrally formed with the cap body and having a third latching surface disposed to engage the first latching surface to hold the first flap in a latched position sealing the first hole;

a first living hinge formed between and directly joining the planar and circular top and the cap body to the first flap, the first hinge coupling the first flap to the elongate diametral web and permitting the first flap to be moved between a first position in which the first hole is open and a second position in which the fast hole is closed;

a second flap integrally formed with the cap body and having a fourth latching surface disposed to engage the second latching surface to hold the second flap in a latched position sealing the second hole;

a second living hinge formed between and directly joining the planar and circular top and the cap body to the second flap, the second hinge coupling the second flap to the elongate diametral web adjacent to the first flap and permitting the second flap to be moved between a first position in which the second hole is open and a second position in which the second hole is closed, wherein the first hinge is indented in a central portion thereof sufficient to hold the first flap closed when the first and third latching surfaces are not latched, and wherein the second hinge is indented in a central portion thereof sufficient to hold the second flap closed when the second and fourth latching surfaces are not latched; and wherein the first and second flaps are indented in a central portion thereof and further wherein the indentation of the central portion of the flaps is reduced when the flaps are opened.

9. The molded plastic cap of claim 8, wherein the hinges are indented the same amount as the flaps are indented.

10. The molded plastic cap of claim 9, wherein the top surfaces of the first and second flaps and the top surface of the cap body are coplanar.

* * * * *